United States Patent [19]

Millar

[11] Patent Number: 4,837,555

[45] Date of Patent: Jun. 6, 1989

[54] PRESSURE-RESPONSIVE SECURITY ALARM

[76] Inventor: Frederick W. Millar, 3 Fenton Crescent, Frankston, Australia, VIC 3199

[21] Appl. No.: 219,861

[22] Filed: Jul. 12, 1988

Related U.S. Application Data

[63] Continuation of Ser. No. 61,282, Jul. 15, 1987, abandoned.

[30] Foreign Application Priority Data

Aug. 12, 1985 [AU] Australia ..... PH1895

[51] Int. Cl.[4] ..... G08B 13/08

[52] U.S. Cl. ..... 340/544; 340/568; 340/571; 340/626

[58] Field of Search ..... 340/544, 568, 626, 571

[56] References Cited

U.S. PATENT DOCUMENTS 2,069,953 2/1937 Hopkins ..... 340/544

4,117,468 9/1978 Vásquez ..... 340/571

*Primary Examiner*—Glen R. Swann, III

*Attorney, Agent, or Firm*—Finnegan, Henderson, Farabow, Garret & Dunner

[57] ABSTRACT

Apparatus is provided to evacuate an air-tight openable and closeable container to a sub-atmospheric pressure. A flexible diaphragm inside the container responds to a change in pressure to actuate an alarm. In one embodiment, a display case is evacuated via a one-way valve by connecting a pump thereto. In a different embodiment, a pump inside a hand-carried case evacuates the case via a one-way valve. Alternatively, at least one side of the case is flexible enough to evacuate the case by pushing thereon, with no pump being required.

7 Claims, 2 Drawing Sheets

FIG. 2
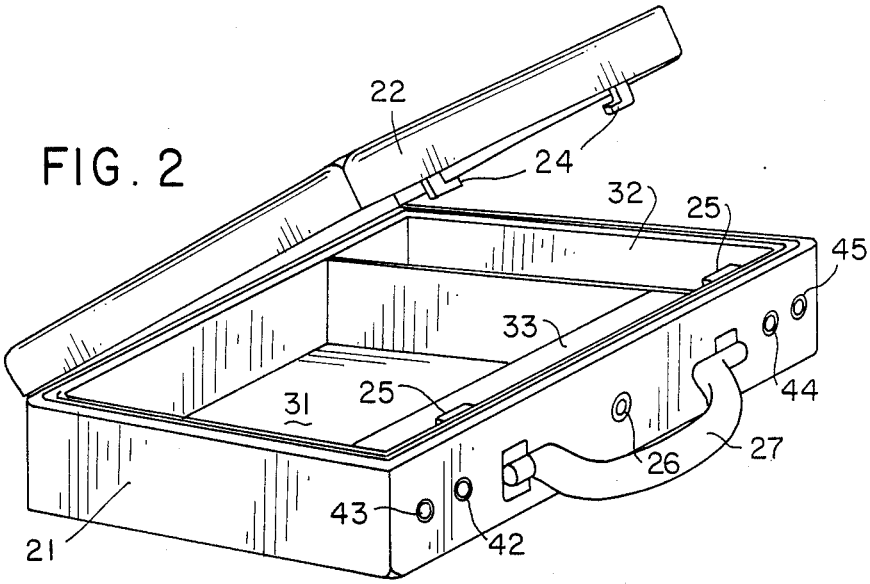
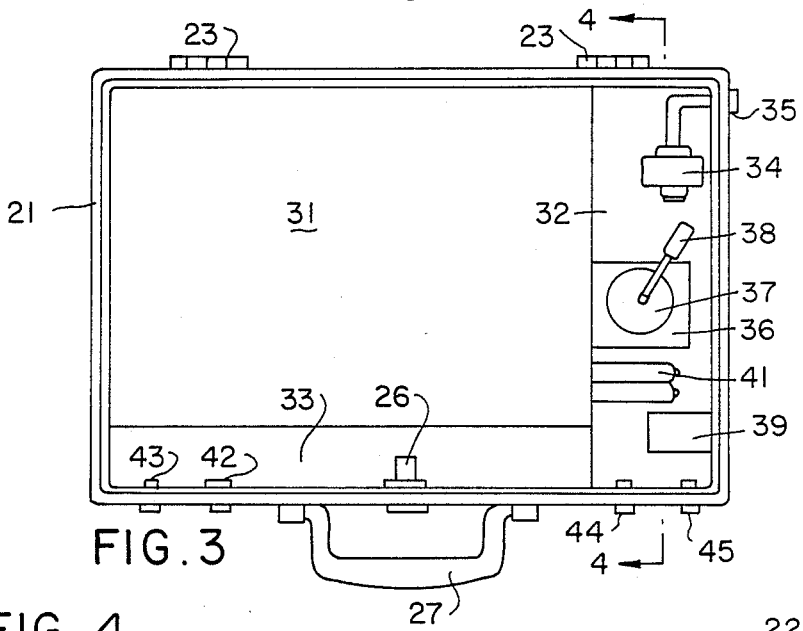
FIG. 3
FIG. 4
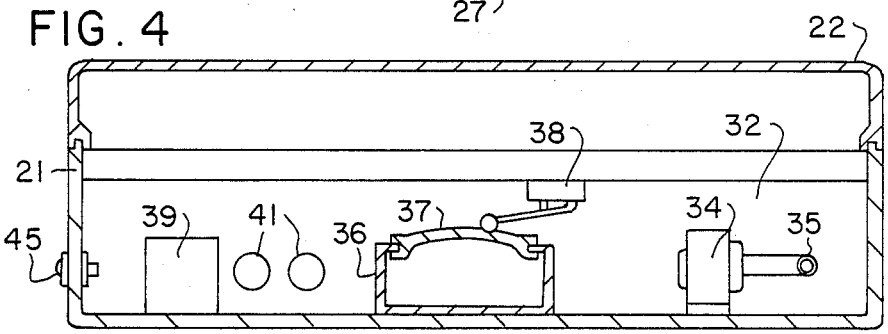

PRESSURE-RESPONSIVE SECURITY ALARM

This application is a continuation of application Ser. No. 061,282, filed July 15, 1987 now abandoned.

TECHNICAL FIELD

This invention relates to security apparatus for protecting valuable property. Such property may comprise cash, documents, jewelry or works of art to be stored transported or displayed.

The invention is particularly, but not exclusively, applicable to the protection of objects to be displayed in display cabinets and with the protection of any form of property which can be transported in small containers. It provides an inexpensive yet effective means for securing property in these circumstances.

DISCLOSURE OF THE INVENTION

According to the invention there is provided security apparatus comprising an openable and closable container for valuable property, means to enable the interior of the container to be held at non-atmospheric pressure, and alarm means conditionable by a change of pressure in the container interior to cause an alarm signal.

Preferably the means to enable the interior of the container to be held at non-atmospheric pressure is such as to enable the interior of the container to be evacuated to sub-atmospheric pressure.

The container may be a display case or cabinet, in which event it may have a transparent wall through which to view the interior and any contents thereof.

Alternatively the container may be in the form of a transportable case. It may, for example, be designed to have an appearance similar to that of a conventional briefcase. The means enabling evacuation of the interior of the container may then comprise a non-return air outlet valve in the wall of the case and pumping means operable to expel air through that valve when the case is closed.

The pumping means may comprise a mechanical air pump disposed within the case. Alternatively the case body may be resiliently deformable to act as a bellows to expel air through the valve when the case is closed.

BRIEF DESCRIPTION OF THE DRAWINGS

In order that the invention may be more fully explained two particular embodiments will be described in some detail with reference to the accompanying drawings in which:

FIG. 2 is a perspective view of a briefcase incorporating security apparatus in accordance with the invention;

FIG. 3 shows the interior of the briefcase illustrated in FIG. 2; and

FIG. 4 is a cross-section on the line 4—4 in FIG. 3.

BEST MODES OF CARRYING OUT THE INVENTION

Figure 1:
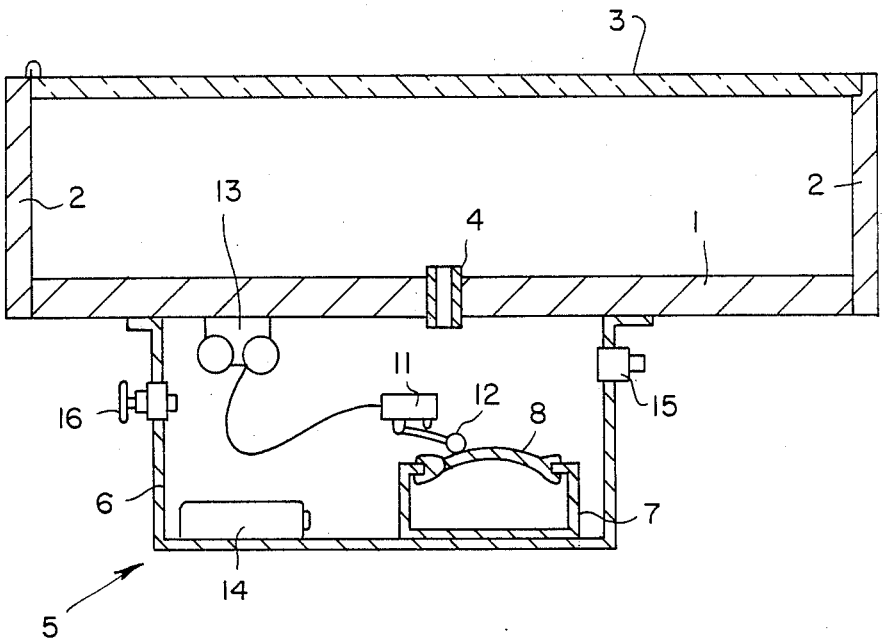
FIG. 1 is a diagrammatic view of a display case fitted with a security apparatus in accordance with the present invention.

The display case shown in FIG. 1 has a floor 1, side walls 2 and an openable and closable swinging glass lid 3. The display case is made to be airtight with suitable sealing adhesives.

A small tube 4 is installed through the bottom of the case to allow air to pass between the interior of the case and an alarm control unit 5 fitted to the underside of the case floor. The alarm control unit 5 comprises a housing 6 the interior of which communicates with the interior of the case through the tube 4. Mousing 6 contains a small hollow casing 7 which encloses a reservoir of air and which has a flexible diaphragm 8 formed in one wall., A switch 11 disposed within housing 6 has an actuator 12 in engagement with the diaphragm 8 so as to be actuated by movement of the diaphragm. This switch is wired to an alarm 13 disposed within the housing and powered from a rechargeable battery 14.

Air can be pumped from the interior of the display case through the control unit via a suction fitting 15 provided with a non-return valve. This causes the diaphragm to set the switch so as to turn the alarm circuit on. Any attempt to open or break the display case will destroy the negative pressure within the system, so causing movement of the diaphragm and actuation of the alarm. The alarm mechanism is very sensitive and only a small amount of air need be removed from the case. An air inlet tap 16 may be provided in association with a lock which deactivates the alarm when opened, so as to enable air to be admitted to the case and the case to be opened without triggering the alarm when the lock is opened. The diaphragm and switch mechanism could be replaced by a pressure transducer or other suitable device operating in an electronic circuit.

The briefcase illustrated in FIGS. 2 and 3 comprises two body portions 21, 22 hinged together by hinges 23. The case can be closed by interfitting catch elements 24, 25 and locked by a key actuated lock 26. Body portion 21 is fitted with a carrying handle 27.

The interior of the case has a main compartment 31 to receive valuables and two outer compartments 32, 33 which contain security system components. The components comprise an air pump 34 operable when the case is closed to pump air from the interior of the case through an air outlet 35 which is fitted into the side wall of case component 21 and includes a non-return valve. A further component of the security system is a small hollow casing 36 which encloses a reservoir of air and which has a flexible diaphragm 37 formed in one wall. Diaphragm 37 engages an actuator arm of an electric switch 38 which controls activation of a sonic alarm 39 powered by batteries 41 also installed within compartment 32.

The front wall of component 21 is provided adjacent handle 27 with an air inlet tap 42 to let air into the case when it is to be opened. This may be coupled with the lock mechanism so that air can only be admitted when the lock is opened and the lock may be connected to the electrical circuit to deactivate the alarm when opened. The front wall of the case is also provided with a battery charge state indicator lamp 43 wired to the battery circuit. A switch 44 is also wired into the electrical circuit to control operation of air pump 34 and a red light 45 is provided to indicate that the alarm is active.

The interengaging rims of the two case components 21, 22 are formed so as to come together in an airtight seal. One or both of the rims may be fitted with a flexible gasket for this purpose. When the case is closed, the air pump 34 is operated to expel air through air outlet 35 and so reduce the pressure within the case to sub-atmospheric pressure. This will cause a slight expansion of the reservoir of air in casing 36 and movement of the diaphragm 37 to set the switch 38 so that the alarm circuit is switched on and the red light 45 is illuminated.

Any unauthorised attempt to open the case will result in loss of vacuum pressure within the interior of the case, resulting in a movement of diaphragm 37 to actuate switch 38 so as to activate the alarm. The alarm will then emit an alarm signal. Appropriate circuitry may be included to cause lamp 45 to be illuminated in short flashes in these circumstances. Opening of lock 26 deactivates the alarm and allows admission of air through air inlet tap 42 to allow the case to be opened without triggering the alarm.

In a modification to the illustrated briefcase, the air pump 34 may be omitted and the two main walls of the case formed with sufficient resilience to enable them to be flexed in and out to provide a bellows action to expel air through the air outlet 35 in order to create the necessary sub-atmospheric pressure in the interior of the case when closed. In a further modification a dye bomb may be installed within the interior of the case to release dye onto the contents of the case in the event that the alarm circuit is activated. The dye bomb may comprise an aerosol pack of dye with an appropriate trigger mechanism actuated on activation of the alarm circuit. The trigger mechanism may, for example, comprise an electric solenoid wired to switch 38.

I claim:

1. A display case comprising:

an openable and closeable hollow case having a transparent wall through which to view the interior thereof and means providing a substantially airtight interior to the case when it is closed;

an alarm housing mounted on said case and defining a substantially airtight interior chamber, said housing being in gas communication with the interior of the case;

evacuation means to enable said chamber and with it the interior of the case to be evacuated to a sub-atmospheric pressure when the case is closed; and alarm means located within the alarm housing and activatable by a change of pressure in said chamber to cause an alarm to signal.

2. The display case of claim 1, wherein the evacuation means comprises a suction fitting in a wall of the alarm housing through which suction can be applied to the interior of the chamber, said fitting being a non-return valve so as to maintain the sub-atmospheric pressure in the chamber and in the case.

3. The display case of claim 1, wherein said alarm means comprise a diaphragm movable upon a change of pressure within the chamber and an electric circuit having an electric switch actuable by movement of the diaphragm, said circuit being connected to the alarm to activate the alarm's signal when the switch is actuated.

4. A hand case, comprising:

a hollow case body having a main body portion and a lid portion swingable between a case-open position and case-closed position, said body defining a substantially airtight internal chamber when the case is closed;

a non-return air outlet valve in the wall of the case body;

pump means within the case body and connected to the non-return air outlet valve to expel air from said chamber through the valve to the atmosphere when the case is closed to thereby evacuate the chamber to sub-atmospheric pressure; and alarm means located within the chamber and activatable by a change of pressure within said chamber to cause an alarm to signal.

5. The hand case of claim 4, wherein said alarm means comprises a diaphragm movable upon a change of pressure within the chamber, and an electrical circuit having an electric switch actuable by movement of the diaphragm said circuit being connected to the alarm to activate the alarm's signal when the switch is actuated.

6. A hand case, comprising:

a hollow case body having a main body portion having at least one resiliently deformable wall and a lid portion swingable between a case-open and a case-closed position, said body defining a substantially airtight internal chamber when the case is closed;

a non-return air valve in the body to provide one way communication between the chamber and the atmosphere exterior of the case; whereby, upon deformation of the wall, air from the chamber is expelled to the atmosphere through the valve when the container is closed to create a sub-atmospheric pressure in the chamber; and alarm means located within the case and activatable by a change of pressure within said chamber to cause an alarm to signal.

7. The hand case of claim 6, wherein said alarm means comprises a diaphragm movable upon a change of pressure within the chamber, and an electric circuit having an electric switch actuable by movement of the diaphragm, said circuit being connected to the alarm to activate the alarm's signal when the switch is actuated.

* * * * *